US007419588B2

(12) United States Patent
Lawson

(10) Patent No.: US 7,419,588 B2
(45) Date of Patent: Sep. 2, 2008

(54) SUMP GRATE FOR A SWIMMING POOL

(76) Inventor: Robert B. Lawson, 4431 Corporate Square, Naples, FL (US) 34104

( * ) Notice: Subject to any disclaimer, the term of this patent is extended or adjusted under 35 U.S.C. 154(b) by 67 days.

(21) Appl. No.: 11/633,064

(22) Filed: Dec. 4, 2006

(65) Prior Publication Data

US 2008/0128342 A1 Jun. 5, 2008

(51) Int. Cl.
*E04H 4/16* (2006.01)

(52) U.S. Cl. ..... 210/164; 210/167.16; 210/474; 4/504; 4/507

(58) Field of Classification Search ..... 210/163, 210/164, 474, 498, 167.16; 4/504, 507
See application file for complete search history.

(56) References Cited

U.S. PATENT DOCUMENTS 2,701,027 A * 2/1955 Scoville ..... 210/163
3,378,858 A * 4/1968 Jacuzzi ..... 210/163
3,674,149 A * 7/1972 Donalson ..... 210/163
4,345,998 A * 8/1982 Graffis et al. ..... 210/164
4,658,449 A * 4/1987 Martin ..... 210/163
5,130,016 A * 7/1992 Gavin ..... 210/164
5,529,431 A * 6/1996 Walsh ..... 210/164
6,170,095 B1 * 1/2001 Zars ..... 4/507
6,397,408 B1 * 6/2002 Veloskey et al. ..... 4/504
6,442,774 B2 * 9/2002 Wilson et al. ..... 4/504
6,453,482 B1 * 9/2002 Mullings ..... 4/507
6,751,814 B2 * 6/2004 Mattson et al. ..... 4/504
7,178,179 B2 * 2/2007 Barnes ..... 4/507

* cited by examiner

*Primary Examiner*—Christopher Upton

(57) ABSTRACT

A grate cover in combination with a swimming sump being installed in a recess in the top of the sump. The grate cover having a multiple of interstices or openings there through. The size of the interstices being held to a minimum so that fingers of a human cannot be sucked into the openings. The top surface of the grate cover has a curvature thereon while the bottom surface is flat. This way, the forceful suction within the sump cannot obtain enough force to suction the skin of a human against the grate cover to cause any injuries.

5 Claims, 2 Drawing Sheets

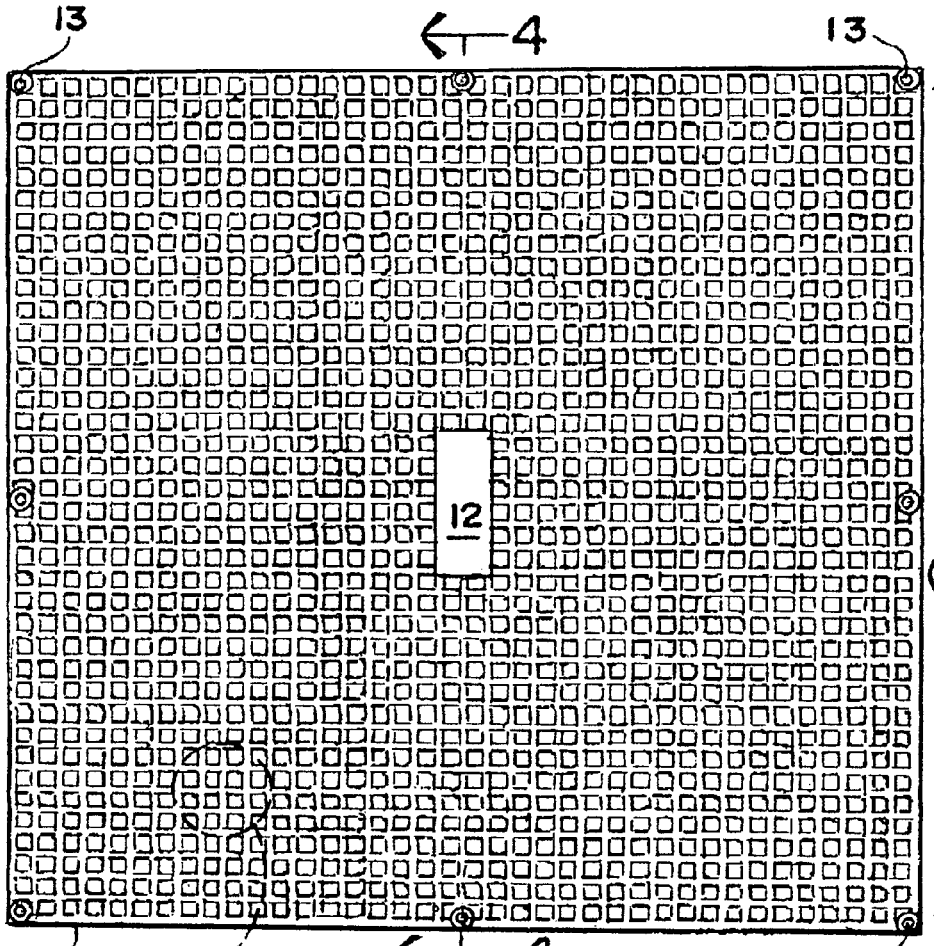
FIG.2
FIG.4
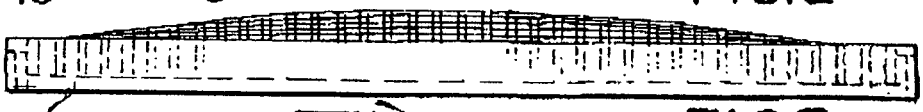
FIG.3
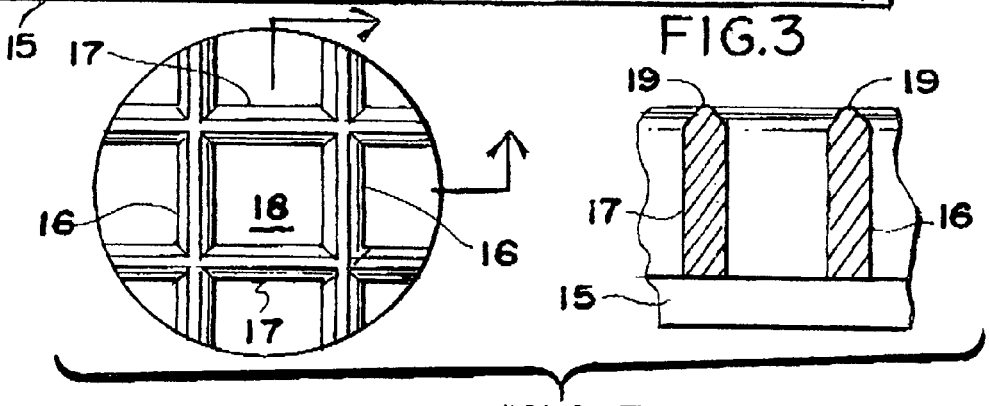
FIG.5

SUMP GRATE FOR A SWIMMING POOL

FIELD OF THE INVENTION

Most all swimming pools have a drainage sump located mostly in the deep end bottom of the pool for draining the pool when necessary and also for participating in the circulation in the pool water which is circulating through the filter system.

BACKGROUND OF THE INVENTION

The above mentioned sump is of a pot-like configuration and has a grating installed over the opening to prevent any of larger debris from entering into the sump and to prevent any contact of the human limbs with the considerable suction force in the bottom of the sump to avoid any injury. Most of the sump covers known in the art have a flat surface and the covers have many interstices therein to catch anything on the flat surface thereon while the water is suctioned into the sump. It has been found, that in many instances, the force of the suction is of such intensity that a human body can be trapped on top of the cover and the body of the person cannot be removed unless emergency procedures are undertaken.

BRIEF DESCRIPTION OF THE INVENTION

The example of the following sump is shown and claimed in a copending application Ser. No. 11/207,153. The sump is fabricated quite differently from the known sumps in that the sump is injection molded instead of being fabricated from PVC sheets. The sump has a tapered body which considerably increases the strength of the body and which allows a multiple of bodies to be stacked into each other for storage and for shipping.

BRIEF DESCRIPTION OF THE DRAWINGS

FIG. 2 is a top view of the inventive grate cover for a sump body;

FIG. 3 is a front view of the grate cover;

FIG. 4 is cross section through the grate cover;

FIG. 5 is an enlarged view of a section of the grate.

DETAILED DESCRIPTION OF THE INVENTION

Figure 1:
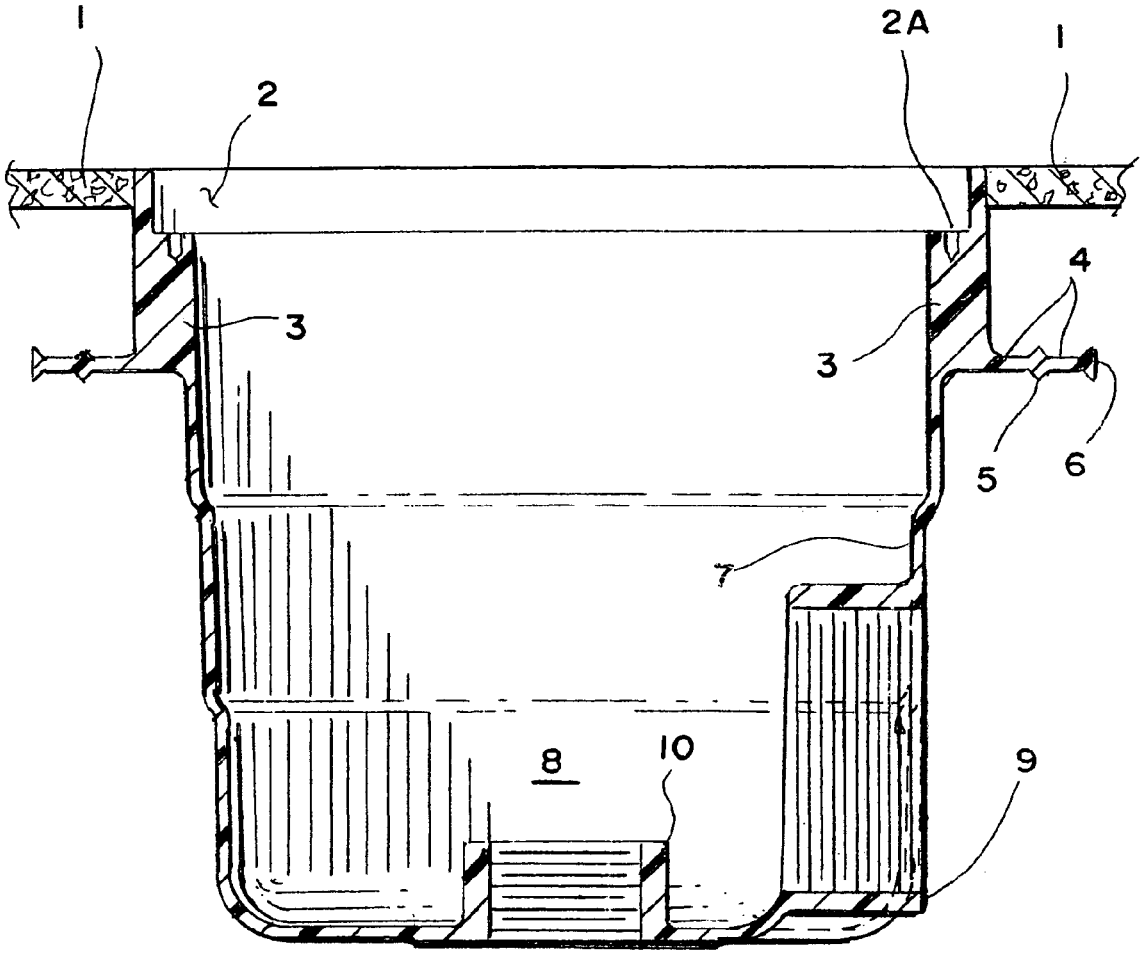
FIG. 1 is a cross section through a sump body.

FIG. 1 shows a sump in a cross section as it is installed in concrete 1 flush with the surface of the concrete 1. The top of the sump has a recess 2 to receive the inventive grate therein to be fastened into the recess 2 by way of screws that are driven into the pilot holes 2A. The upper part or section of the sump has thickened side wall 3 to give it added strength. Just below the thickened side wall 3 there is a laterally extending disc 4 which surrounds the body of the sump. In the middle and at the end or periphery of the disc there are upper and lower ridges 5 and 6 which act as water stops once the sump is installed within the concrete of the pool. These water stops are accomplished by way of the ridges 5 and 6 which present an obstacle to any water trying to pass there over.

As mentioned above, the body of the sump is tapered by way of several sections to render the same stackable and to act as reinforcements once installed in concrete. There is a thickened upper section 3 and below that section 3 is a second inwardly tapering section and there is a third inwardly tapering section 8. One of the side walls of the sump body has a connection receiving tube and an inwardly directed flange therein. As mentioned above, the purpose of this flange, being directed inwardly, is to prevent the presence of an outwardly directly flange from being damaged in handling and/or transport. The same principle applies to the bottom drainage flange 10 which is also directed inwardly.

The sump shown in FIG. 1 is only explanatory because the subsequently shown grate cover can be installed in many different sumps of different styles and constructions. Most all swimming pool sumps experience the same problems and that is, most all sumps have a potential force of suction that can be harmful to swimmers in the pool. The sump can be of a circular, rectangular or elliptical configuration but they all face the same problem of severe suctional forces.

FIG. 2 shows the inventive square grate cover which would be installed in the recess 2 shown in FIG. 1 and would be fastened therein by way of screws 2A and through the screw holes 13 in the grate cover 11. The top of the grate cover 11 has an ID plate 12 which will indicate the specific tolerances of a particular grate cover. The top of the grate cover 11 has a curved complex configuration, as is shown in FIGS. 3 and 4. Because of this particular curvature, a human coming in contact with any part of the human body cannot be suctioned down onto the surface of the grate. In addition, the extent of the curvature 14 is limited to stay somewhat within the outer and overall circumference of the grate cover. This extent is shown in FIG. 4 by the arrow B while the arrow C in FIG. 4 indicates the overall extent of the grate cover 11. As can be seen in FIGS. 3 and 4, the cover is of a unitary construction between the curved top surface and the flat bottom surface.

FIG. 5 shows the configuration of a certain section A of the pool grate cover 11. The pool grate is interspersed with a multiple of interstices 18 which are held to a minimum of dimensions. The size of the interstices should be held in a square shape of between $8.00^2$ mm to $11.00^2$ mm. This assures that not even a finger of a human can be sucked into the sump by way of a forceful suction. The walls of the square interstices 16 and 17 have a reduced upper surface 19 by way of forming ribs thereon of a reduced cross section which will be instrumental in still further reducing the contact that can be had with the skin of a human when coming into contact with the grate 11. The numeral 15 indicates a peripheral margin in FIGS. 2-5.

It can now be seen that the pool grate cover is quite superior in performance when compared with the covers known in use because experiments and tests have shown that the skin of a human cannot be attracted to the surface of the cover because the contact area is too small and the curvature on the top surface does not allow greater areas of any limbs to be attracted to the surface of the grate cover because the suction force from inside of the sump cannot find enough contact areas to be effective to cause injuries. This inventive grate cover should be installed in all pools in condos, apartment complexes, olympic size pools or even pools used in a home environment.

The thickness of the grate should be between 23 mm and 27 mm.

The invention claimed is:

1. A pool grate cover in combination with a sump, said grate cover being installed in a top recess of said sump, said grate consisting of a multiple of interstices distributed throughout said grate cover, said interstices are formed by front and lateral walls to form square configurations, said grate cover has a curved top surface and a flat bottom surface and is of a unitary construction with said walls extending between said top surface and said bottom surface.

2. The grate cover of claim 1, wherein said curvature on top of said is restricted to an extent which is less than the extent of the outer periphery of said cover.

3. The grate cover of claim 1 wherein said front and lateral walls forming said interstices have reduction ribs on top of said walls to limit to limit contact with the skin of a human making contact with said grate cover, said reduction ribs being of a reduced cross section.

4. The grate cover of claim 1, wherein said interstices have a dimension between 7 $mm^2$ to $11^2$ mm.

5. The grate cover of claim 1, wherein said grate cover has a thickness between 24 mm and 27 mm.

* * * * *

UNITED STATES PATENT AND TRADEMARK OFFICE

CERTIFICATE OF CORRECTION

PATENT NO. : 7,419,588 B2
APPLICATION NO. : 11/633064
DATED : September 2, 2008
INVENTOR(S) : Robert B. Lawson It is certified that error appears in the above-identified patent and that said Letters Patent is hereby corrected as shown below:

In the Claims

In Col. 2 line 56 (Claim 1), after "grate" insert --cover--; In Col. 2 line 63 (Claim 2), after "said" insert --grate cover--; In Col. 2 line 64 (Claim 2), after "said" insert --grate--; In Col. 2 line 67 (Claim 3), after "walls" delete first occurrence of "to limit".

Signed and Sealed this
Nineteenth Day of May, 2015

Michelle K. Lee

Michelle K. Lee
*Director of the United States Patent and Trademark Office*